US005165611A

United States Patent [19]

Ragnarsson

[11] Patent Number: 5,165,611

[45] Date of Patent: Nov. 24, 1992

[54] WOOD SIZE REDUCTION APPARATUS

[76] Inventor: Anders T. Ragnarsson, 66 Pelham Rd., Salem, N.H. 03079

[21] Appl. No.: 635,880

[22] Filed: Dec. 28, 1990

[51] Int. Cl.[5] ..... B02C 13/06; B02C 13/28

[52] U.S. Cl. ..... 241/88.4; 241/189.1; 241/191

[58] Field of Search ..... 241/88.4, 189 R, 197, 241/191, 195, 189 A

[56] References Cited

U.S. PATENT DOCUMENTS

| | | | |
|---|---|---|---|
| 646,249 | 3/1900 | Williams | 241/197 |
| 764,268 | 7/1904 | Boileau | 241/91 |
| 2,045,691 | 6/1936 | Armstrong | 241/189 R |
| 3,224,688 | 12/1965 | Beiter | 241/189 R |
| 4,151,959 | 5/1979 | Deister | 241/69 |
| 4,177,954 | 12/1979 | Ostreng | 241/167 |
| 4,226,375 | 10/1980 | Cameron | 241/88.4 |
| 4,919,344 | 4/1990 | McKie | 241/32 |

*Primary Examiner*—Mark Rosenbaum
*Assistant Examiner*—John M. Husar
*Attorney, Agent, or Firm*—Davis, Bujold & Streck

[57] ABSTRACT

A comminutor for reducing large diameter wood products and stumps to size, comprised of a reduction chamber, with an impact rotor positioned concentrically therein, in combination with a housing, drive motor and infeed chute. The impact rotor is formed with a plurality of horizontally elongated impact hammers at its periphery. The impact hammers are arranged in sets of impact hammer rows oriented at an angle to the rotational axis of the impact rotor. Each set of impact hammers has one row of hammers having radial angles increasing along the rotor's longitudinal axis in the axial direction of the rotor and a second opposing row of hammers having radial angles decreasing along the rotor's longitudinal axis in the axial direction of the rotor. The rotor is positioned so that the elongated wood product or stump falling under the influence of gravity through the infeed chute is directed against the impact hammers, and repelled ahead of the rotor's rotational direction against an anvil formed along one side of the reduction chamber.

18 Claims, 5 Drawing Sheets 69
110
111
112
54
63
66
68
62
64
60
55
61
65
113
53
115
114
52

WOOD SIZE REDUCTION APPARATUS

BACKGROUND OF THE INVENTION

This invention relates to comminutors, and more particularly to an impact rotor assembly for reducing large diameter wood products and stumps to size.

Impact crushers for the reduction and classification of ore utilizing an impact rotor to obtain the initial reduction of large ore chunks are known in the prior art. See U.S. Pat. No. 3,887,141 to P. M. Francis. Francis discloses a mill in a single housing. A primary reduction chamber located within the housing is fed raw ore with variable particle sizes up to and including chunks on the order of 1 foot in diameter. An impact rotor is positioned within the primary reduction chamber and secured to the output shaft of a drive motor. The impact rotor mounts a plurality of elongated hammer bars around its periphery. These hammer bars are oriented parallel to the rotational axis of the impact rotor. The rotor is positioned so that the ore, falling under the influence of gravity, is directed against the hammer bars and repelled therefrom with great force against the sides of the primary reduction chamber.

Application of Francis-type pulverizing mills to wood waste is also known. See U.S. Pat. No. 4,151,959 to C. L. Deister. The Deister patent discloses an impact pulverizer having a rotor located concentrically within a reduction chamber. The rotor has a plurality of generally radially-extending impact blades. The radial angle of the blades increases along the axis of the rotor to provide each of the blades with a slope in the axial direction of the rotor. The spiral rotational action of the pieces as they are propelled and ricocheted around the primary reduction chamber achieves a faster pulverizing action than Francis-type pulverizing mills. The spiral rotational action also requires less power that the Francis mill.

Prior art pulverizing mills are ineffective in reducing logs because the wood is not hard enough to shatter, i.e., the resiliency of wood requires a shearing and grinding effect. Although neither the Francis nor the Deister mills are able to reduce wood logs to size, the principal of the spiral Deister rotor has been applied to a rotary wood hog for reducing logs. Rawlings Construction Co. of Montana, markets a rotary wood hog which uses a helical rotor to reduce elongated wood products to size. By use of an anvil at the front of the rotary hog, the Rawlings helical rotor is able to shear and grind pieces of the log during each revolution of the rotor.

The increasing radial angle of the Rawlings rotor blades attempts to move the material being acted upon in a generally spiral rotational motion. Because logs are generally most efficiently fed into a rotary wood hog at lengths of ten feet or more and in a direction where a log's longitudinal axis is parallel to the rotor's radial axis, the spiraling action of the rotor blades will move the end of the log being acted upon by the rotor toward one corner the reduction chamber. The log being reduced will thereby tend to change from an upright vertical position to a horizontal position frequently causing a bridging-type jam when the length of the log matches the width of the rotor housing, i.e., the log will bridge the rotor and block additional material from reaching the rotor blades. This is especially a problem when dealing with larger diameter wood products, i.e., 24 inches to 40 inches because of the extensive shut down required to remove the jammed pieces which are large and heavy. Even without jamming, uneven wear of the rotor blades will take place.

SUMMARY OF THE INVENTION

In view of the foregoing disadvantages inherent in the known types of devices now present in the prior art, the present invention provides a shredder/crusher for reducing larger diameter wood products to size. As such, the general purpose of the present invention, which will be described subsequently in greater detail, is to provide a shredder/crusher which will not jam when comminuting wood products.

To attain this, the present invention comprises in combination with a housing and a drive motor, a reduction chamber disposed within the housing. An infeed chute is connected to the chamber and is adapted to feed larger diameter wood products and stumps to the interior thereof.

An impact rotor is positioned concentrically within the reduction chamber and operatively connected to the drive motor. The impact rotor is formed with a plurality of horizontally elongated impact hammers at its periphery. The impact hammers are arranged in sets of impact hammer rows oriented at an angle to the rotational axis of the impact rotor. Each set of impact hammers has one row of hammers having radial angles increasing along the rotor's longitudinal axis in the axial direction of the rotor and a second opposing row of hammers having radial angles decreasing along the rotor's longitudinal axis in the axial direction of the rotor. The rotor is positioned so that the elongated wood product to stump falling under the influence of gravity through the infeed chute is directed against the impact hammers, and repelled ahead of the rotor's rotational direction against an anvil forced along one side of the reduction chamber. The impact hammer arrangement provides shearing of that portion of the wood product engaged by the rows of hammers. The action of each set of opposing rows of impact hammers on the wood product keeps the wood product generally horizontally and vertically positioned at its point of entry thereby avoiding bridge jamming and uneven wear on the impact hammers. The reduced wood product is forced onto a grating positioned about the bottom of the chamber. The continuous rotation of the impact rotor will grind and press sheared pieces of wood product through the grate openings to a desired size.

According to the invention there is provided an apparatus for comminuting wood by shearing comprising a housing having a comminution cavity disposed therein; an rotor mounted for rotation within said housing about an axis of rotation; a drive means for rotating said rotor; an infeed means to said cavity; a plurality of comminuting blades mounted on said rotor disposed to form oppositely oriented helical blade arrays each coaxial with said axis of rotation; and an egress means for exiting comminuted particles from said cavity.

Also according to the invention there is provided an apparatus for comminuting wood shearing comprising a housing, having a comminution cavity disposed therein; an rotor mounted for rotation within said housing about an axis of rotation; an infeed means connected to said cavity and extending substantially the entire length of said rotor; a plurality of blades mounted on said rotor and disposed to form a plurality of oppositely oriented circumferentially spaced separate helical arrays of said blades coaxial with said axis of rotation, said blades each having a cutting surface oriented in the direction of rotation of said rotor; and wherein said cavity has an anvil means positioned to cause wood being comminuted to be sheared by rotation of said blades.

The instant invention overcomes Rawlings' tendency to jam when reducing larger diameter wood products, while still taking advantage of Deister's shearing effect. The instant invention's arrangement of impact hammers or blades in sets with opposing helical rows results in the log tending to stay in that same position relative to the rotor as when it first entered the reduction chamber against the anvil while the impact hammers or blades shear the wood.

This together with other objects of the invention, along with various features of novelty which characterize the invention, are pointed out with particularity in the claims annexed hereto and forming a part of this disclosure. For a better understanding of the invention, its operating advantages and the specific objects attained by its uses, reference should be had to the accompanying drawings and descriptive matter in which there is illustrated a preferred embodiment of the invention.

DETAILED DESCRIPTION OF THE INVENTION

Figure 1:
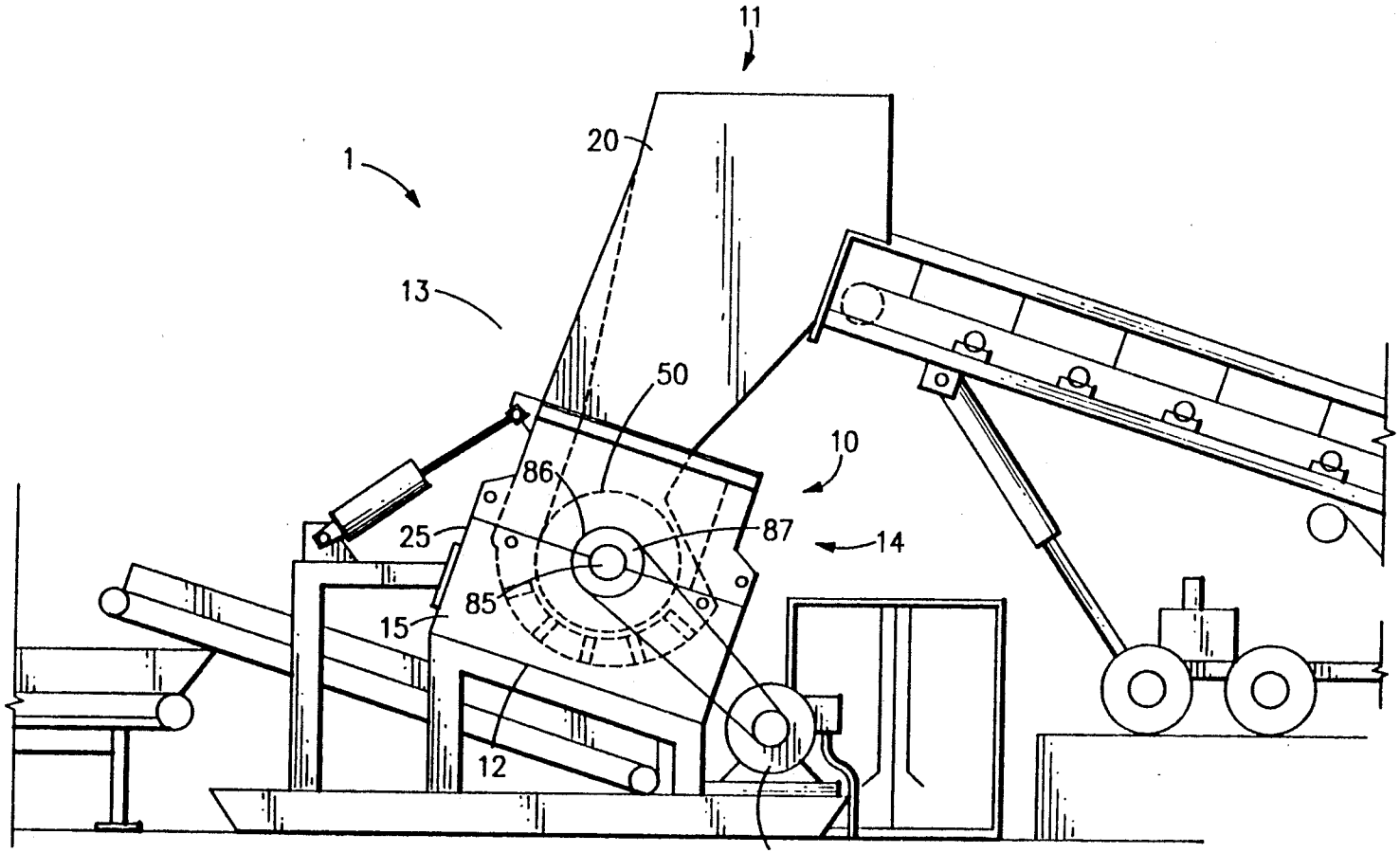
FIG. 1 is a side plan view of one embodiment of a shredder/crusher according to the present invention.
Figure 2:
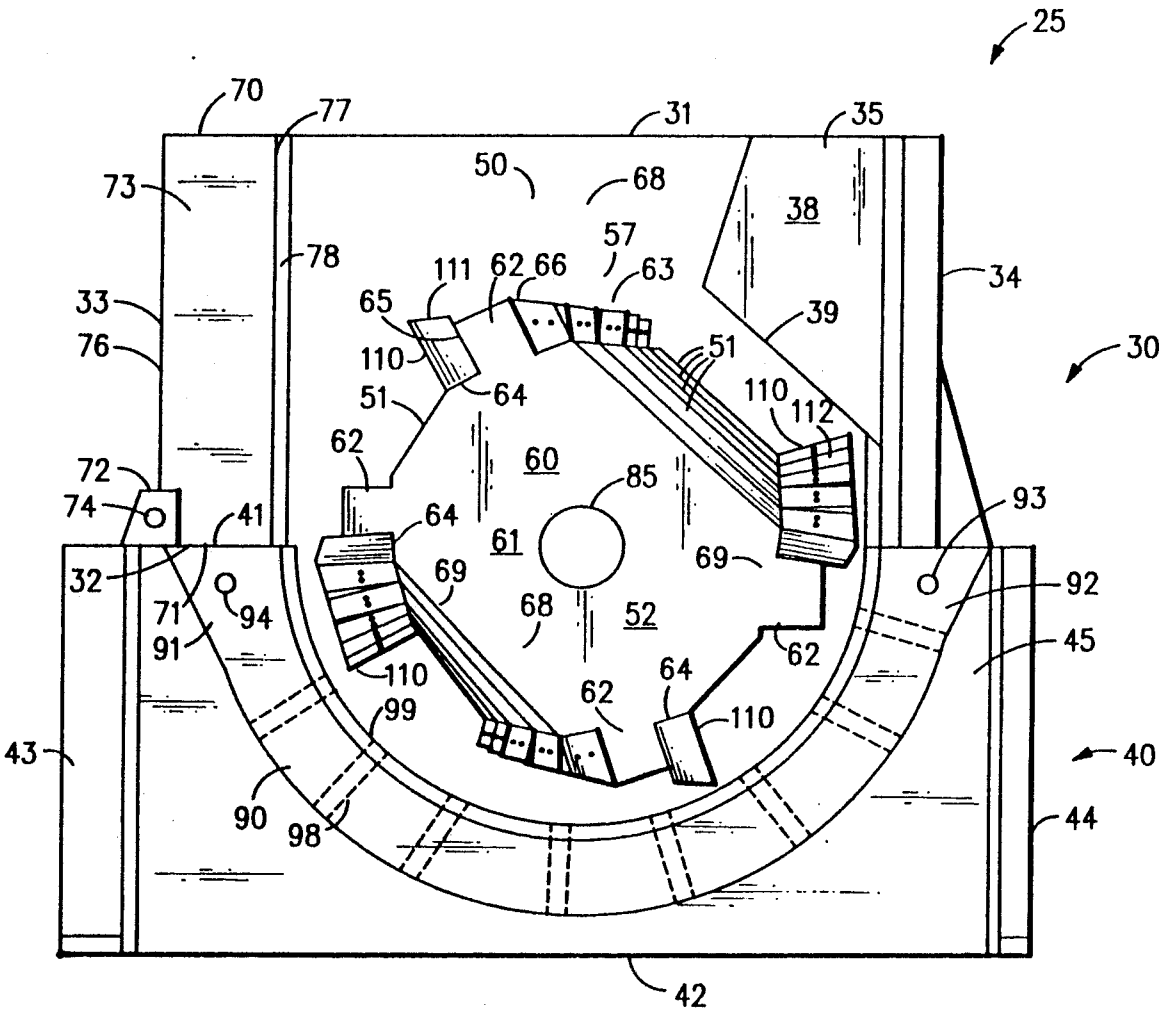
FIG. 2 is a side sectional view of the shredder/crusher.

Referring to the drawings in detail wherein like elements are indicated by like numerals, there is shown an embodiment of the invention 1 comprising a shredder/crusher with a rotary assembly for reducing large diameter wood products and stumps to size. The present invention has a housing 10 with a top 11, bottom 12, front 13, back 14 and two sides 15, and a drive motor 5. A reduction chamber 25 is centrally disposed within the housing 10. A downwardly sloping infeed chute 20 is joined to the reduction chamber 25 and is adapted to feed large diameter wood logs, stumps and other wood products such as telephone poles, pilings, railroad ties, beams and posts, to the interior of the reduction chamber 25. Mounted interiorly of the reduction chamber 25 is an impact rotor 50. The rotor 50 is carried on a shaft 85 which extends transversely across the reduction chamber 25, penetrates the housing sides 15 and is seated on bearings (not shown) bolted to support plates 86 bolted to the outside of the housing sides 15. One protruding end 87 of the shaft 85 is operatively connected to the drive motor 5 which provides rotational power to the shaft 85.

The impact rotor 50 is comprised of a plurality of axially contiguous, disk-like segments 51. When installed on the shaft 85 expandable lock rings (not shown) bind the rotor outside segments 52, 54 to the shaft 85. The body 60 of each segment 51 has a generally quadrilateral shape and is welded to each adjacent segment 51. The side faces 61 of the segments 51 are ground absolutely flat and the resulting friction between the side faces 61 of adjacent segments 51 will help keep the rotor segments 51 turning together without slippage and also provides for perfect alignment of each segment's central radial shaft opening 55. Each segment 51 is as wide as possible. In this embodiment, a 60 inch rotor length embodiment is illustrated containing five axial segments 51, each of which is 12 inches wide. In this embodiment of the invention each axial segment 51 has a main body 60 and four generally radially extending impact hammers 62 about its periphery 57. The impact hammers 62 also form a seat portion 64 for a striker plate 110. Each impact hammer 62 has two threaded holes 63 for bolting a striker plate 110 with two corresponding holes 113 to the front face 65 of the hammer 62. The front face 65 of a hammer 62 is defined as that side facing in the counterclockwise direction of impact rotor 50 rotation as shown in FIGS. 1-5. Each striker plate 110 is attached to a hammer front face 65 by means of a bolt 114 inserted through each striker plate hole 113 into a corresponding impact hammer hole 63. The bolt holes 113 and 63 are positioned as low as possible on the hammer 62, i.e., close to the axial segment main body 60. The bolts 114 are threaded and are held in place by cooperation of their threads with the hammer hole 63 threads. Alternatively, each bolt 114 could be held in place by means of a nut 115 on the back side 66 of the hammer 62.

The axial segments 51 are so arranged about the shaft 85 that the impact hammers 62 are formed into sets 67 of impact hammer rows 68, 69 and oriented at an angle to the counter-clockwise rotational axis of the impact rotor 50. Each set 67 of impact hammers 62 has one longitudinal row 68 of impact hammers 62 having radial angles increasing along the rotor's longitudinal axis in the axial direction of the rotor 50 and a second opposing row 69 of impact hammers 62 having radial angles decreasing along the rotor's longitudinal axis in the axial direction of the rotor 50. The radial angle of increase and decrease which provides the best shearing is 15 degrees. As rotor length increases, the radial angle may decrease to approximately 10 degrees. The maximum radial angle range appears to be 5 degrees to 25 degrees.

Figure 3:
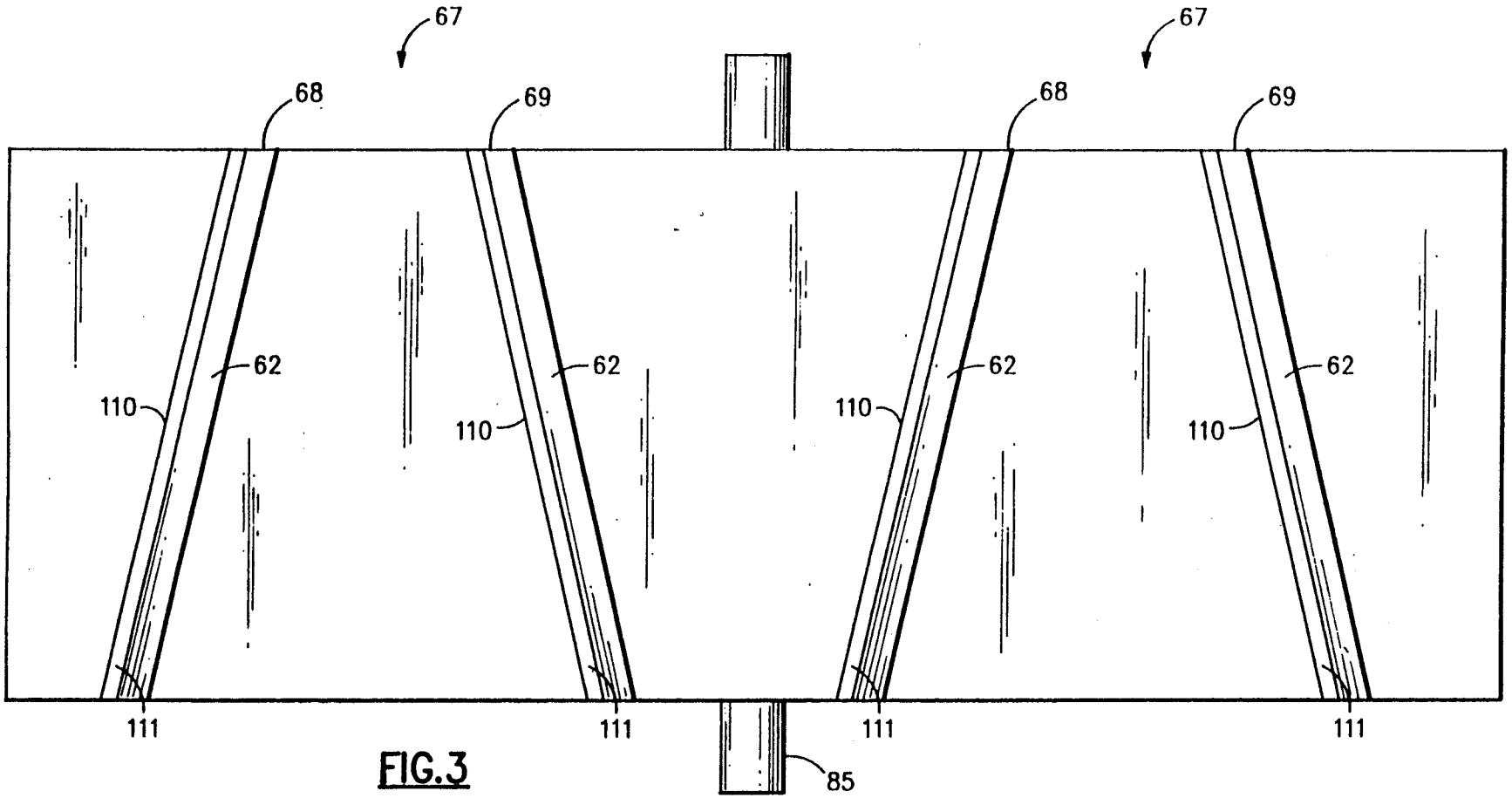
FIG. 3 is a flattened diagrammatic view of the impact rotor of the present invention.
Figures 4A, 4B, 4C:
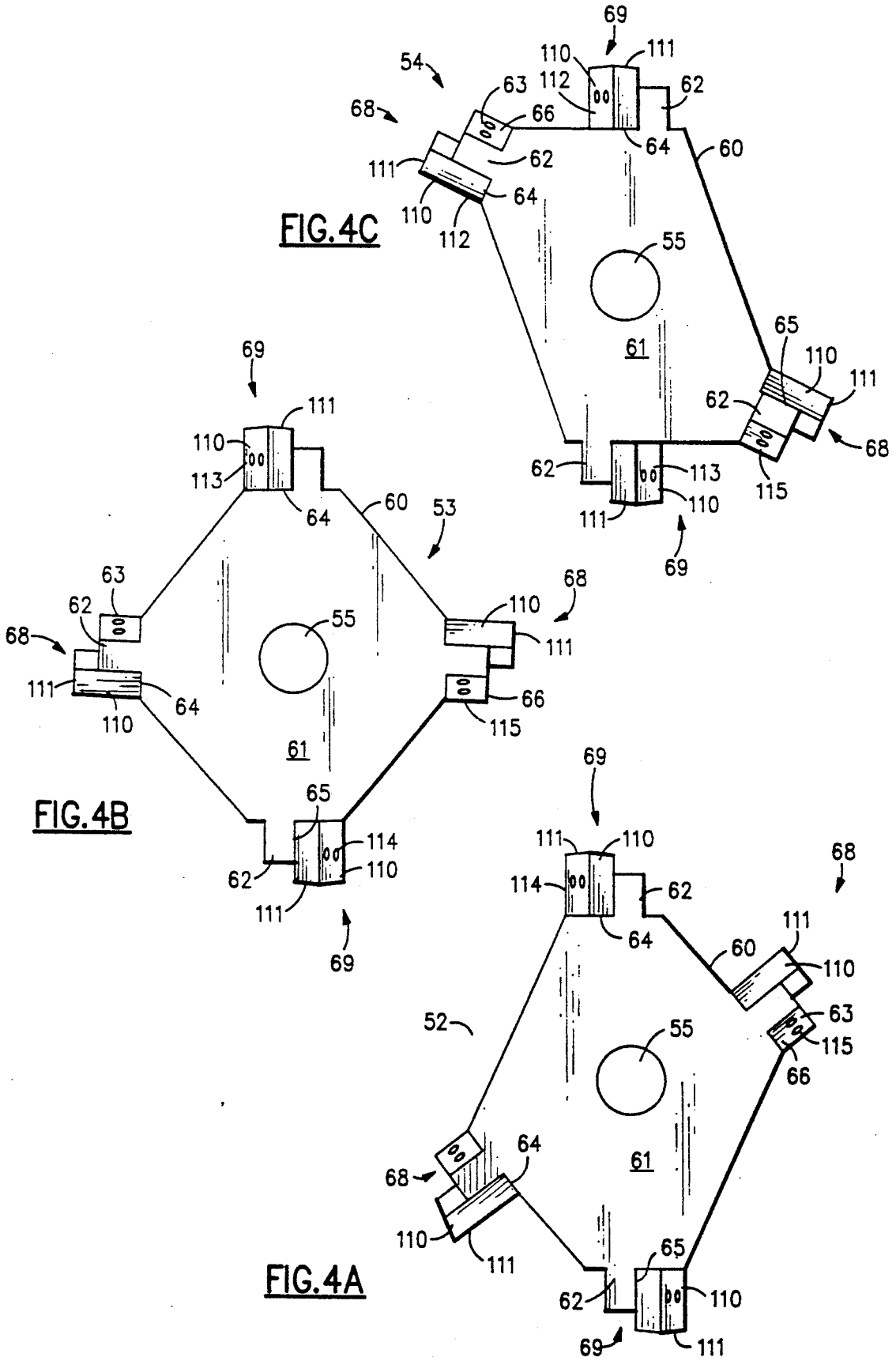
FIG. 4A is a side elevational view of the first rotor segment in FIG. 2.
FIG. 4B is a side elevational view of the middle rotor segment in FIG. 2.
FIG. 4C is a side elevational view of the last rotor segment in FIG. 2.
Figure 5:
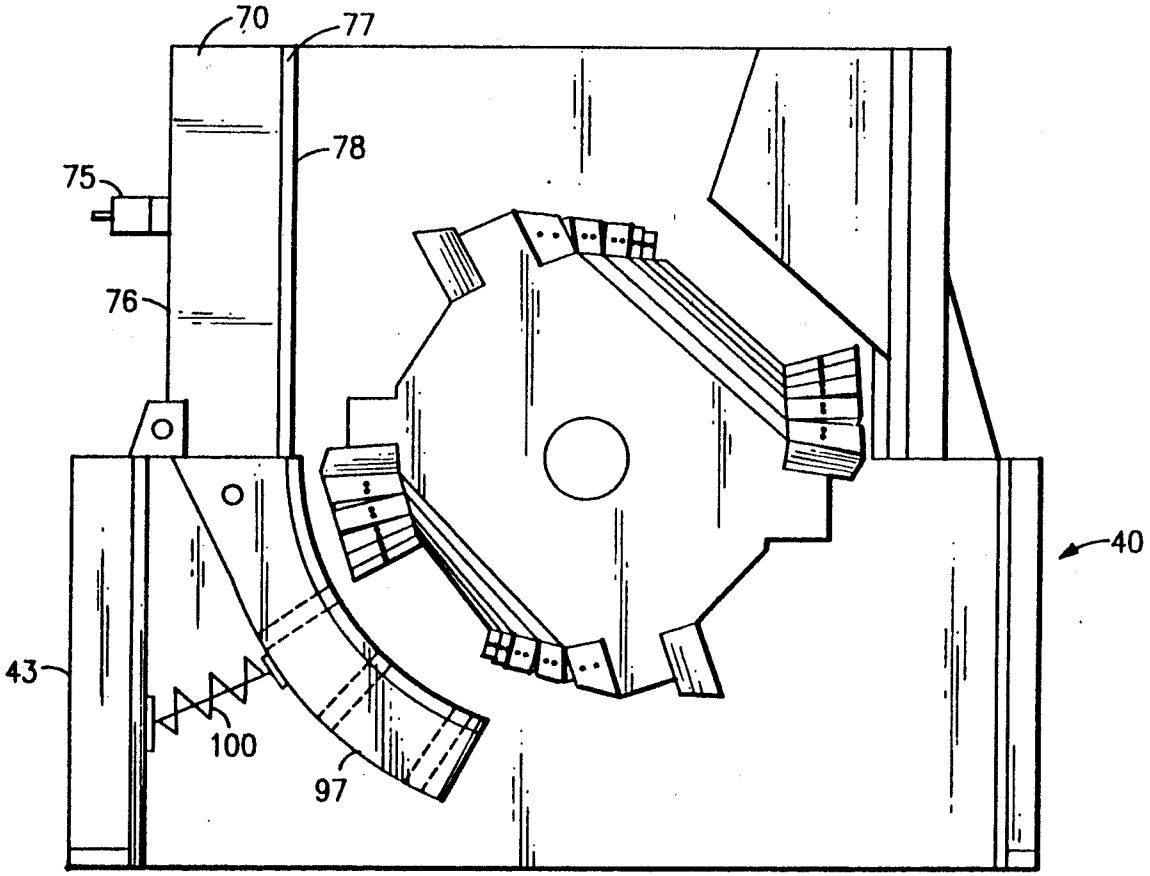
FIG. 5 is a side sectional view of another embodiment of the invention.

This arrangement of sets 67 and rows 68, 69 is illustrated diagrammatically in FIG. 3. To better understand the rotor segment configuration, FIGS. 4A-4C illustrate the two end segments 52 and 54 as well as the middle segment 53 of the present five segment embodiment and should be examined in conjunction with FIG. 3. The second and fourth segments are not shown. The first segment 52 is the segment 51 fully visible in FIG. 2.

The rotor 50 is centrally positioned within the reduction chamber 25 so that the elongated wood product or stump falling under the influence of gravity through the infeed chute 20 is directed against the striker plates 110 attached to the impact hammers 62, and repelled ahead of the rotor's rotational direction against an anvil 70 formed along the upper front portion 33 of the reduction chamber 25. The anvil 70 has a wear plate 78 attached to its rearward face 77. The impact hammer arrangement of the present invention shears that portion of the wood product engaged by the impact hammer striker plates 110 and the anvil bottom 71. In the present invention's nominal 60 inch rotor, the impact rotor 50 rotates at a rate of 400 revolutions per minute. This provides 1600 hammer row hits on the wood product per minute. The effect of this is that the action of the opposing rows 68, 69 of impact hammers 62 in each set 67 on the wood product keeps the wood product generally positioned vertically and horizontally at the same relative point where it initially entered thereby avoiding jamming and uneven wear on the impact hammers striker plates 110.

The reduction chamber 25 has an upper portion 30 and a lower portion 40. The rotor shaft 85 is horizontally and centrally positioned between the upper and lower portions 30, 40 transversely extending across the reduction chamber 25. The upper reduction chamber portion 30 has a quadrilateral polygonal shape and has a top 31, bottom 32, front 33, back 34, and two sides 35. The upper portion top 31 opens and is connected to the bottom 21 of the infeed chute. The striker plate top 111 to opposing striker top 111 segment diameter of the impact rotor 50 is slightly less than the front 33 to back 34 length of the reduction chamber upper portion 30. As stated above the upper portion has an anvil 70 formed along the upper front portion 33 of the reduction chamber 25. The anvil 70 acts as a counter-weight and shearing surface aid for the rotor 50. Because wood is so resilient, the anvil 70 must be an absolutely solid surface. In this embodiment the anvil 70 is made of steel and is 12 inches thick and approximately 60 inches wide. A one inch thick wear plate 78 is attached to the rear surface of the anvil 70. The direction of rotation of the impact rotor 50 is counterclockwise towards the anvil 70. Wood product is thrown against the anvil wear plate 78 by the striker plates 110. The anvil-backed wear plate 78 then momentarily holds the wood product in place while the impact hammer-backed striker plates 110 shear portions of the wood product as the striker plates 110 by the bottom 71 of the anvil 70 and wear plate 78. The anvil bottom 71 has a small vertical flange 72 on each side 73. The flanges 72 protrude through the housing front 13 and are connected to the housing front 13 by means of shear bolts 74. The advantage of this arrangement over prior art devices is that the sheared bolt 74 can be easily removed. Prior art devices usually have the shear bolts threaded into the side 73 of the anvil plate 70.

Across the reduction chamber upper portion back wall 34 a wedge shaped piece 38 having a quadrilateral cross section is attached. The purpose of the wedge 38 is to keep logs from hitting the impact hammers rows 68, 69 on the vertical upward portion of their rotation cycle and being thrown back out of the infeed chute 20. The quadrilateral shape eliminates a "shelf" for material to land upon.

The reduction chamber lower portion 40 also has a generally quadrilateral polygonal shape and has a top 41, bottom 42, front 43, back 44, and two sides 45. The lower portion top 41 opens up to and forms the upper portion bottom 32. A curved grate assembly 90 comprised of a frame 98 and grate insert 99 is positioned along the lower periphery 57 of the impact rotor 50 for passing comminuted material of a desired size. The grate 90 is connected at one end 91 at the approximate juncture of the upper and lower portion front walls 33, 43 just below the anvil 70, and at its other end 92 at the approximate juncture of the upper and lower portion back walls 34, 44. As the wood product is sheared, the reduced wood product is pushed onto the grate 90. The rotating impact rotor 50 will press the reduced wood product through the grate 90. The residue of reduced wood product which does not pass through the grate 90 is returned by the impact rows 68, 69 to the reduction chamber upper portion 30. The residual wood product is thrown against the wedge's lower side 39 and then again against the anvil 70 and wear plate 78 for further reduction. The grate 90 is connected at its rear end 92 by means of a removable hinge bolt 93. The grate front end 91 is connected by means of two removable shear bolts 94. In case of a serious jam the shear bolts 94 will break thereby releasing the grate 90 and preventing damage to the grate and impact rotor 50. The bolts 93 and 94 are removable to permit removal of the grate insert 90 and reinstallation in the reverse direction. Since the grate insert holes (not shown) wear in a front to rear direction, reversal avoids the necessity of immediate replacement of the entire grate 90 because of wear. Grates 90 under this arrangement will last twice as long.

Although the present invention is designed primarily for use with larger diameter wood products, it may also be used for other typical pulverizable materials. When pulverizable materials such as concrete with reinforced bars are to be reduced, the present invention may have two options added. As may be seen in FIG. 5 a blade spring 75 is attached horizontally across the anvil's forward face 76 and attached to the housing front 13. The anvil's rearward face 77 has the wear plate 78 against which the pulverizable material is hammered. Use of the blade spring 75 will allow the anvil 70 to flex during comminution of particularly hard materials and thereby decrease the potential for jamming. The invention's grate 90 is also changed, especially when reducing concrete with reinforcing bars which do not lend themselves to reduction and must be removed from the pulverizer. The concrete and bars are substantially separated by the hammering action as described above. If the same grating was used as with wood product reduction, the bars would almost immediately jam up the grating insert 99. The wood reduction grate assembly 90 is therefore replaced with a partial grate assembly 95 positioned to the front 43 of the reduction chamber lower portion 40. The grate insert openings 96 (not shown) are elongated with a longitudinal axis in the direction or rotation of the impact rotor. A spring system 100 is installed between the grate assembly 95 and front wall 43. The spring system 100 is joined to the partial grate assembly under surface 97 and provides flexing as the reinforcing bars pass through, thereby substantially reducing the potential for jamming.

In the embodiments described above the axial segments 51 have a preferably solid main body 60 made of solid steel construction. Conventional air intake means are used within the reduction chamber.

It is understood that the above-described embodiments are merely illustrative of the application. Other embodiments may be readily devised by those skilled in the art which will embody the principles of the invention and fall within the spirit and scope thereof.

I claim:

1. An apparatus for comminuting wood by shearing comprising:

a) a housing having a comminution cavity disposed therein;

b) an impact rotor mounted for rotation within said housing about an axis of rotation;

c) a drive means for rotating said rotor;

d) an infeed means to said cavity;

e) a plurality of comminuting blades mounted on said rotor disposed to form oppositely oriented helical blade arrays each coaxial with said axis of rotation; and f) an egress means for exiting comminuted particles from said cavity.

2. An apparatus according to claim 1 wherein a drive motor is operatively connected to rotate said rotor.

3. An apparatus according to claim 1 wherein each said blade defines an impact face aligned with the helical angle of the helical array with which it is associated whereby the impact faces of all blades of each array together form a substantially continuous helical impact face coaxial with said axis of rotation.

4. An apparatus according to claim 3 wherein the oppositely oriented helical arrays are mirror images of one another.

5. An apparatus according to claim 3 further comprising an anvil positioned within said cavity to cooperate with said blades in said comminution.

6. An apparatus according to claim 3 further comprising a grate assembly positioned so that comminuted wood product is forced onto the grate assembly and the rotation of the rotor grinds and shears said product so as to force said product through said grate assembly.

7. An apparatus according to claim 1 wherein said infeed means extends for substantially the entire axial length of said rotor and is positioned to allow the influence gravity to cause a wood product to be directed against said blades.

8. An apparatus according to claim 1 wherein there are at least four separate said helical arrays disposed evenly about said rotor.

9. An apparatus according to claim 8 wherein said helical arrays do not circumferentially overlap and each extend substantially the entire axial length of said rotor.

10. An apparatus according to claim 1 wherein there are at least four separate said helical arrays of alternating opposite orientations.

11. An apparatus according to claim 1 further comprising a wedge shaped means positioned within said cavity to impede wood from being repelled by said rotor out through said infeed means.

12. An apparatus according to claim 1 wherein the arrays are separate from one another.

13. An apparatus according to claim 1 wherein each helical blade array has only a single helical orientation and is circumferentially spaced from each next adjacent helical blade array.

14. An apparatus according to claim 13 wherein each helical blade array has an opposite helical orientation to each next adjacent helical blade array.

15. An apparatus for comminuting wood by shearing comprising a housing, having a comminution cavity disposed therein;

an impact rotor mounted for rotation within said housing about an axis of rotation;

an infeed means connected to said cavity and extending substantially the entire length of said rotor;

a plurality of impact blades mounted on said rotor and disposed to form a plurality of oppositely oriented circumferentially spaced separate helical arrays of said blades coaxial with said axis of rotation, said blades each having a cutting surface oriented in the direction of rotation of said rotor; and wherein said cavity has anvil means positioned to cause wood being comminuted to be sheared by rotation of said blades.

16. An apparatus according to claim 15 wherein said anvil means includes a removable grate assembly positioned adjacent said blades to shear said wood being comminuted and to allow adjacent said blades to shear said wood being comminuted and to allow wood chips from said cavity and a means to impede material being comminuted from being ejected through the infeed means.

17. An apparatus according to claim 15 wherein each helical blade array has only a single helical orientation and is circumferentially spaced from each next adjacent helical blade array.

18. An apparatus according to claim 17 wherein each helical blade array has an opposite helical orientation to each next adjacent helical blade array.

* * * * *